United States Patent [19]

Tanaka et al.

[11] Patent Number: 4,463,744

[45] Date of Patent: Aug. 7, 1984

[54] DISTRIBUTORLESS IGNITION SYSTEM WITH SURGE ABSORBING MEANS AND APPARATUS THEREFOR

[75] Inventors: Minoru Tanaka, Takahagi; Takeshi Ishizuka; Kenzo Shima, both of Hitachi, all of Japan

[73] Assignee: Hitachi, Ltd., Tokyo, Japan

[21] Appl. No.: 241,374

[22] Filed: Mar. 6, 1981

[30] Foreign Application Priority Data

Mar. 7, 1980 [JP] Japan ..... 55-27914

[51] Int. Cl.[3] ..... F02P 1/00

[52] U.S. Cl. ..... 123/643; 123/634; 123/647; 123/630; 123/653; 123/655

[58] Field of Search ..... 123/643, 654, 653, 655, 123/656, 634, 647, 630; 361/56

[56] References Cited

U.S. PATENT DOCUMENTS

| | | | |
|---|---|---|---|
| 1,335,933 | 4/1920 | Bohli | 123/653 |
| 3,045,148 | 7/1962 | McNulty | 123/655 |
| 3,328,614 | 6/1967 | Falge | 123/655 |
| 3,334,271 | 8/1967 | Bacon | 361/56 |
| 3,403,666 | 10/1966 | Soehner | 123/655 |
| 3,454,790 | 7/1969 | Rockwell | 361/56 |
| 3,546,572 | 12/1970 | Specht | 361/56 |
| 3,581,725 | 6/1971 | Hemphill | 123/653 |
| 3,673,998 | 7/1972 | Phillips | 123/653 |
| 3,765,391 | 10/1973 | Cook | 123/653 |
| 3,896,480 | 7/1975 | Harnden | 361/56 |
| 3,910,247 | 10/1975 | Hartig | 123/656 |
| 4,110,775 | 8/1978 | Festa | 361/56 |
| 4,138,710 | 2/1979 | Tsukuru | 123/655 |
| 4,232,351 | 11/1980 | Baker | 361/56 |

*Primary Examiner*—Ronald B. Cox

*Attorney, Agent, or Firm*—Antonelli, Terry & Wands

[57] ABSTRACT

A distributorless ignition system in which a primary current alternately changing in its flowing direction is supplied to the primary winding of an ignition coil to induce a high secondary voltage alternately changing in polarity across the secondary winding of the ignition coil, and the induced voltage is sequentially distributed through a plurality of rectifiers such as diodes to a plurality of associated spark plugs thereby sequentially causing jumping of a spark across the spark gap of the spark plugs. An apparatus for mounting such a distributorless ignition system is also disclosed. In the invention, a surge voltage absorber is associated with each of the diodes, so that a surge voltage, which may be induced across the secondary winding of the ignition coil due to failure of normal sparking as when one or more of the spark plugs are removed or excessive wear occurs on the electrodes of one or more of the spark plugs, can be effectively absorbed without the possibility of damage to the diode or diodes and insulating members.

3 Claims, 8 Drawing Figures

DISTRIBUTORLESS IGNITION SYSTEM WITH SURGE ABSORBING MEANS AND APPARATUS THEREFOR

BACKGROUND OF THE INVENTION

1. Field of the Invention

This invention relates to an ignition system for use with an internal combustion engine, for example, an automobile engine, and also to an apparatus useful for such an ignition system.

2. Description of the Prior Art

In an ignition system used for igniting an internal combustion engine, for example, an automobile engine, a distributor having mechanical contacts has been incorporated for sequentially distributing a high voltage induced in an ignition coil to a plurality of spark plugs. However, this system has been encountered with, for example, the problem of noise generation due to incessant on-off of the distributor contacts and the problem of deterioration of the function of the distributor contacts due to wear, moisture, soiling and the like. This system has therefore been defective in that the noise generated from the distributor contacts provides a source of radio interference, and the useful service life of the system is shortened in addition to its reduced reliability.

With a view to obviate these defects resulting from the operation of the distributor having mechanical contacts, a so-called distributorless ignition system (which will be abbreviated as a DIS hereinafter) has been proposed.

Typically, the DIS comprises a plurality of series circuits each including a diode and a spark plug and connected in parallel to the secondary winding of an ignition coil such that the polarities of the diodes with respect to the secondary winding are inverted in every other one of the circuits so that the current flows through the circuits are alternately reversed and an electrical power source circuit connected to the primary winding of the ignition coil for supplying a primary current periodically in synchronism with the ignition timing of the internal combustion engine to be ignited through the DIS such that the polarity or direction of the primary current with respect to the primary winding is reversed every other cycle of the periodic supply thereby inducing into the secondary winding a high voltage periodically with a polarity inverted in every other cycle.

When the polarity of the high voltage induced in the secondary winding of the ignition coil coincides with the polarity of current turning on one of the diodes in the DIS having the arrangement above described, a spark generates across the spark gap of the spark plug connected in series with that diode, while when the polarity of the high voltage induced in the secondary winding of the ignition coil is opposite to that above described, the specific diode above described blocks the high voltage to prevent generation of a spark across the spark gap of the spark plug connected in series therewith. In this latter case, another diode conducts, and a spark generates across the spark gap of the spark plug connected in series therewith. Since the individual spark plugs are associated with the individual cylinders of the engine respectively, the spark energy necessary for igniting the engine can be sequentially supplied to the individual spark plugs by controlling the timing of supplying the primary current to the primary winding of the ignition coil.

Such a DIS is disclosed in, for example, U.S. Pat. No. 3,910,247 issued to G. Hartig on Oct. 7, 1975. Also, a more basic form of the DIS is disclosed in U.S. Pat. No. 1,335,933 issued to J. Bohli on Apr. 6, 1920. Reference to these U.S. patents will provide further detailed knowledge of the basic principle of the DIS.

The conventional DIS generally has no problem so long as the internal combustion engine incorporated with the DIS is under the normal operating condition, but it has been found that a problem arises sometimes when the engine is driven under an unusual operating condition such that the electrodes of some of the spark plugs are excessively worn or the circuit on the primary side of the ignition coil is energized in the state in which one or more of the spark plugs have been removed from the wiring on the secondary side of the ignition coil for the purpose of, for example, maintenance and inspection of the engine. In such an unusual operating condition, no spark ignition will occur in spite of induction of the high voltage across the secondary winding of the ignition coil. As a result, a surge voltage which is three to ten times as high as the secondary voltage appearing in the normal operating condition will be induced in the secondary winding of the ignition coil. This surge voltage is high enough to destroy the diodes when applied thereto in the reverse direction.

SUMMARY OF THE INVENTION

An object of the present invention is to provide a DIS and an apparatus useful for the same, which are not destroyed even in the event of an unusual operating condition of an internal combustion engine.

Another object of the present invention is to provide such an apparatus of small size the DIS thereby to reduce the cost thereof.

Firstly, the present invention is featured by the fact that, in a DIS which comprises plurality of series circuits, each including rectifying means such as a diode and spark gap means such as a spark plug, and connected in parallel to the secondary winding of an ignition coil such that the rectifying means are connected to have polarities inverted with respect to the secondary winding in every other one of the series circuits as viewed in the order of ignition timing of the spark gap means associated therewith, and also in an apparatus to be used for such a DIS, each of the rectifying means has surge absorbing means associated therewith which operates effectively at a voltage level higher than the level required to generate a spark across the spark gap of the spark plug in the normal operating condition of the engine.

It is the second feature of the present invention that, in addition to the first feature above described, the operating voltage of the surge absorbing means is selected to be lower than the lowest one of the dielectric breakdown voltage levels of electrical insulating members which are used in the DIS or the apparatus and may be subjected to a surge voltage.

It is the principle of the present invention that, when a reverse surge voltage is applied to the rectifying means, the rectifying means does not act to block such a reverse voltage but rather allows the reverse voltage to pass through the surge absorbing means thereby to prevent any further increase in the reverse voltage.

Other objects, features and advantages of the present invention will become apparent from the following detailed description of preferred embodiments thereof taken in conjunction with the accompanying drawings.

DESCRIPTION OF THE PREFERRED EMBODIMENTS

Figure 1:
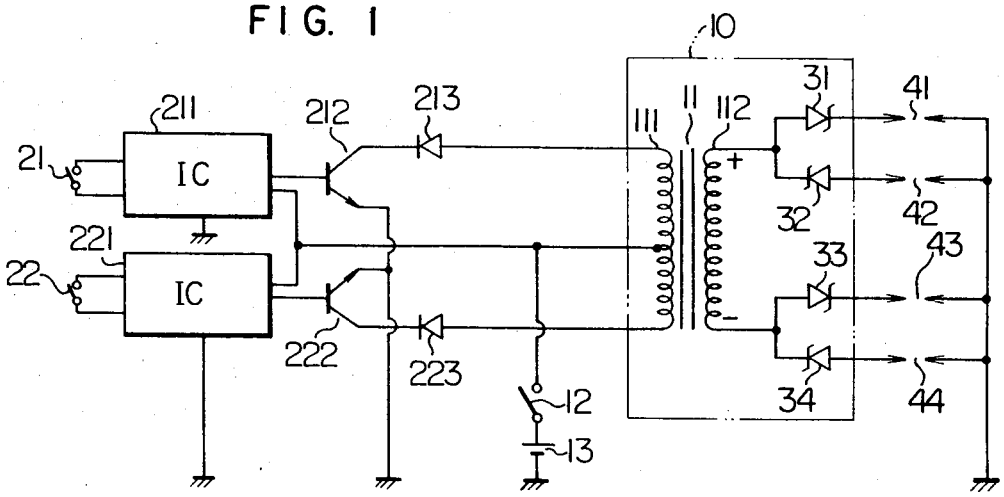
FIG. 1 is a circuit diagram of an embodiment of the DIS according to the present invention.

FIG. 1 is a circuit diagram of an embodiment of the DIS according to the present invention when applied to a 4-cylinder internal combustion engine. The structure and operation of the embodiment will be described with reference to FIG. 1. Referring to FIG. 1, an ignition coil 11 includes a primary winding 111 and a secondary winding 112 having a turns ratio selected, for example, to be about 1:100. The primary winding 111 is provided with a center tapping as shown.

The ends of the primary winding 111 are connected to the anodes of diodes 213 and 223 respectively, and the cathodes of these diodes 213 and 223 are connected to the collectors of transistors 212 and 222 respectively. The emitters of these transistors 212 and 222 are grounded. The tapped center of the primary winding 111 is connected through a power on-off switch 12 to the positive plate of a power source 13. The negative plate of the power source 13 is grounded. The power source 13 is also connected through the switch 12 to IC's 211 and 221 provided for controlling the DIS. These IC's 211 and 221 are connected at their inputs to switches 21 and 22 respectively which are turned on and off in synchronism with the rotation of the engine. The IC's 211 and 221 are connected at their outputs to the bases of the transistors 212 and 222 respectively. The IC's may be constructed in well-known manner to include a detector (not shown) for detecting the ON condition of the switch 21 or 22 and an amplifier (not shown) for supplying an output to the base of the transistor 212 or 222 when the detector detects the ON condition of the associated switch.

When the engine is started after turning on the power on-off switch 12, the switches 21 and 22 are alternately turned on and off to alternately supply base current to the bases of the transistors 212 and 222 thereby alternately turning on these transistors 212 and 222. Consequently, current flows through the path which is traced from the positive plate of the power source 13 to the negative plate of the power source 13 via the switch 12, the tapped center of the primary winding 111, one of the ends of the primary winding 111 and the transistor 212 or 222. Since the transistors 212 and 222 are alternately turned on, the direction of the primary current flowing through the primary winding 111 of the ignition coil 11 changes alternately in one direction and the other.

Series circuits of diodes 31, 32 and spark plugs 41, 42 are connected in parallel with each other between one of the ends of the secondary winding 112 of the ignition coil 11 and ground in such a relation that the direction of the diode 32 is opposite to that of the diode 31. Similarly, series circuits of diodes 33, 34 and spark plugs 43, 44 are connected in parallel with each other between the other end of the secondary winding 112 and ground in such a relation that the direction of the diode 34 is opposite to that of the diode 33. These diodes 31 to 34 have a constant voltage characteristic or Zener characteristic in the reverse direction and are capable of withstanding a high surge voltage.

As a result of alternate on-off of the switches 21 and 22 in the DIS shown in FIG. 1, a high secondary voltage of sequentially changing polarity is induced in the secondary winding 112 of the induction coil 11. When now a high secondary voltage of illustrated polarity is induced in the secondary winding 112, current flows through the diode 31, spark plug 41, spark plug 44 and diode 34 to generate sparks in the spark plugs 41 and 44. At this time, the diodes 32 and 33 are reverse biased to block the high voltage. Then, when a high secondary voltage of opposite polarity is induced in the secondary winding 112, current flows through the diode 33, spark plug 43, spark plug 42 and diode 32 to generate sparks in the spark plugs 43 and 42. At this time, the diodes 31 and 34 are reverse biased to block the high voltage. Thus, the simultaneous spark generation of the spark plugs 41 and 44 occurs repeatedly in alternate relation ship with the simultaneous spark generation of the spark plugs 42 and 43 which also occurs repeatedly. It will be readily understood that these spark plugs are associated with those cylinders, respectively, which are selected such that when the cylinder associated with the spark plug 41 or 42 is under a condition where the spark plug 41 or 42 is to be sparked, the cylinder associated with the spark plug 44 or 43 is under another condition where its operation is not substantially affected by the spark generation of the spark plug 44 or 43. The above cycle is repeated to perform the function of the ignition system.

Figure 2:
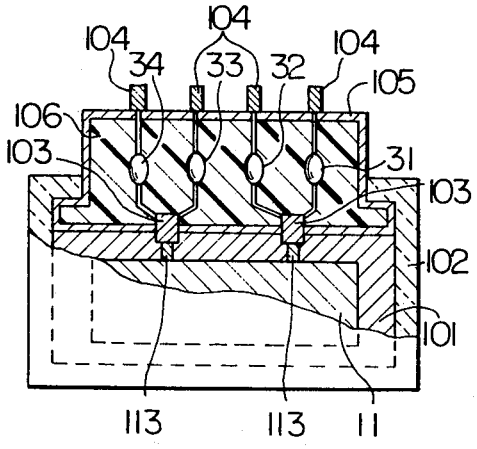
FIG. 2 is a schematic partial sectional view of an embodiment of the apparatus to be used for the DIS shown in FIG. 1.

FIG. 2 is a schematic partial sectional view of an embodiment of the apparatus to be used for the DIS shown in FIG. 1. More precisely, the elements surrounded by the two-dot-dash line 10 in FIG. 1 are mounted in the apparatus.

Referring to FIG. 2, the ignition coil 11 covered with a resin 101 is housed within a coil case 102 made of a resin, and a pair of opposite terminals 113 of the secondary winding 112 of the ignition coil 11 are disposed in an opening formed in the top of the coil case 102. A pair of opposite terminals of the primary winding 111 of the ignition coil 11 are disposed on one of the side walls of the coil case 102 although not shown in FIG. 2.

A bottom portion of a diode case 105 made of a resin is received in the top opening of the coil case 102 to form a one-piece package by combination of the coil case 102 and the diode case 105. The diode case 105 accommodates the diodes 31, 32, 33 and 34 therein. A pair of terminals 103 and four terminals 104 extend through the bottom wall and the top wall respectively of the diode case 105. The terminals 103 are connected to the terminals 113 respectively. The dioes 31, 32, 33 and 34 are connected between the terminals 103 and 104 in the polarities shown in FIG. 1. Conductors wired to the spark plugs 41, 42, 43 and 44 shown in FIG. 1 should be connected to the four terminals 104 respectively. The internal space in the diode case 105 is packed with a resin 106 which is an electrical insulator.

In a structure as shown in FIG. 2, the properties of the resin 106 have great influence on the reliability of the diodes 31, 32, 33 and 34. Therefore, it is desired to use, as the resin 106, a material such as epoxy resin which exhibits good adhesion to the surfaces of the diodes 31 to 34, a coefficient of thermal expansion substantially equal or close to that of the diode, a high insulation, a high heat resistivity, a high moisture resistivity and a low coefficient of contraction. From such view points, an insulating oil may be preferably used in lieu of the resin 106.

In the DIS having such a structure, a reverse voltage applied to each of the diodes 31 to 34 in the normal operating condition of the engine will be approximately equal to the spark discharge voltage which is about 10 kV to 20 kV. There may be, however, an unusual operating condition in which the ignition system may be energized in a state in which at least one of the conductors connecting the individual diodes to the associated spark plugs has been removed for the purpose of, for example, maintenance and inspection of the engine. In such a case, an excessively high reverse voltage (a surge voltage) is applied to the diode which forms the pair with that from which the connecting conductor has been removed. Suppose, for example, that the secondary voltage of illustrated polarity is induced in the secondary winding 112 of the ignition coil 11 in the state in which the conductor connecting the diode 34 to the spark plug 44 has been removed in FIG. 1. In that case, the diode 31 is forward biased, while the diode 33 is reverse biased, and no spark discharge occurs so long as the secondary voltage is being borne or blocked by the diode 33. Therefore, unlike the normal operating condition of the engine, a surge voltage of 40 kV to 50 kV, or higher than that sometimes is applied to the diode 33 in the reverse direction. Such a situation occurs also when one or more of the spark plugs fail to properly generate sparks due to excessive non-uniformity of wear on the spark plug electrodes.

In a conventional DIS including diodes which have not the constant voltage characteristic or Zener characteristic in the reverse direction and which are not satisfactory in the capability of withstanding such a surge voltage, the diode corresponding to the diode 33 in the embodiment of the present invention will be broken down as a result of the application of the excessively high surge voltage, and the function of the DIS will be completely lost. Even when the diodes may have a breakdown voltage level higher than the surge voltage, and the diode corresponding to the diode 33 in the embodiment of the present invention may not be destroyed, the surge voltage of excessively high level will be applied to other members constituting the DIS-mounting apparatus, for example, portions of the insulating materials provided in the apparatus shown in FIG. 2. Such portions of the insulating materials include portions of the resin 106 or the diode case 105 between the terminals 104 and a portion of the resin 101 between the terminals 113 of the secondary winding 112 of the ignition coil 11. Application of such an excessively high surge voltage will break down the insulation in these portions. To avoid the insulation from being broken down, an insulating material which shows a higher insulation performance and is therefore frequently more expensive must be used or an increase in the creeping distance is required, and such a requirement provides a hindrance to the desired miniaturization and cost reduction of the apparatus to be used for the DIS.

The aforementioned embodiment of the present invention is capable of solving the problems above described. The diodes 31, 32, 33 and 34 in the embodiment of the present invention exhibit a constant voltage characteristic or Zener characteristic in the reverse direction and are capable of sufficiently withstanding a surge power of excessively high level, as described hereinbefore.

Figure 3:
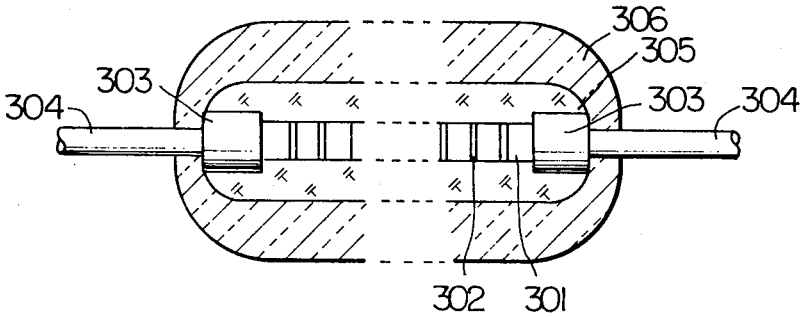
FIG. 3 is a schematic sectional view of the diode preferably employed in the DIS embodying the present invention.

FIG. 3 is a schematic sectional view of one of the diodes employed in the embodiment of the apparatus shown in FIG. 2. Referring to FIG. 3, the diode includes an assembly of a predetermined number of (for example, 30) silicon diode pellets 301 of PIN structure stacked with an aluminum solder 302, and a pair of tungsten electrodes 303 are disposed at the opposite ends of the assembly respectively. A pair of copper leads 304 are coaxially connected to these electrodes 303 respectively. A glass passivation means 305 is molded between the electrodes 303 to enclose the silicon diode pellets 301, and the outer surface of the glass passivation means 305 is covered with an envelope of a resin 306.

In the diode shown in FIG. 3, the PN junction of each individual pellet 301 is finished to be as flat as possible, and the impurity concentration of the I-type or intermediate layer of the PIN structure is selected to exhibit a predetermined constant voltage characteristic in the reverse direction which term is used for indicating the same meaning as avalanche breakdown characteristic or Zener characteristic. A dislocation-free silicon material is used for the manufacture of the pellets 301. In the step of enclosing the pellets 301 in the molded glass passivation means 305, the material of the glass and the glass firing condition were carefully selected so as not to produce voids in the glass passivation means 305.

Figure 4:
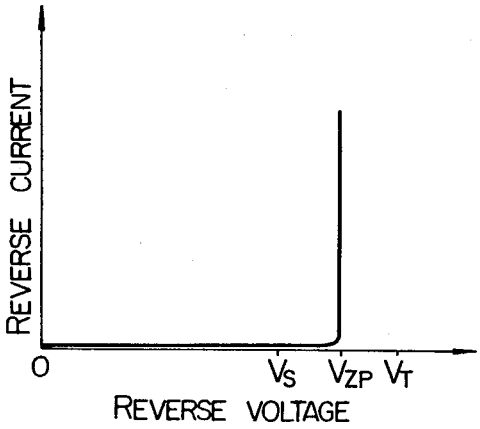
FIG. 4 is a graph showing the reverse voltage to reverse current characteristic of the diode shown in FIG. 3.

The diodes 31, 32, 33 and 34 thus obtained exhibited a constant voltage characteristic in the reverse direction as shown in FIG. 4. In FIG. 4, the symbol $V_{ZP}$ on the horizontal axis represents the avalanche voltage of the diodes employed in the embodiment shown in FIG. 1, $V_S$ represents the voltage required for generating a spark across the spark gap of the spark plugs, and $V_T$ represents the minimum value of the dielectric breakdown voltages of the various insulating materials used in the apparatus shown in FIG. 2. It will be seen in FIG. 4 that $V_{ZP}$ is higher than $V_S$ but lower than $V_T$.

Referring to FIG. 4, the diode employed in the present invention exhibits its blocking characteristic like a conventional diode until the reverse voltage applied thereto attains the level $V_{ZP}$. Upon attainment of $V_{ZP}$, the diode is subject to avalanche breakdown and is immediately placed in a state in which it permits flow of large reverse current. Consequently, the surge voltage would not increase beyond the level $V_{ZP}$.

In the embodiment of the present invention, the value of $V_{ZP}$ is selected to be about 25 kV which is higher than the value of $V_S$ which is generally about 20 kV. Therefore, there is utterly no possibility that the diodes conduct in the reverse direction under the normal operating condition of the engine thereby changing the firing order or causing mal-ignition.

The performance of the diodes employed in the embodiment of the present invention will be described in further detail. It is supposed now that the DIS shown in FIG. 1 is energized in a state in which the conductor connecting the diode 34 to the spark plug 44 has been removed, and as a result, a surge voltage of illustrated polarity is induced in the secondary winding 112 of the ignition coil 11. This surge voltage is applied through the diode 31 to the diode 33 as a reverse voltage. In the prior art arrangement in which such a surge voltage was blocked by the diode 33, the members including the diode 33 and insulating members had to bear the surge voltage, with the result that the diode 33 tended to be destroyed, and the desired miniaturization and cost reduction of the DIS apparatus could not be attained. In contrast to the prior art, the diode 33 in the embodiment of the present invention conducts in the reverse direction when the surge voltage attains the level of $V_{ZP}=25$ kV, and current flows through the diode 31, spark plug 41, spark plug 43 and diode 33 to prevent any further increase in the surge voltage. Therefore, the dielectric breakdown voltages of the individual insulating members need not be as high as that in the prior art and may be relatively low or may be merely of such levels which can sufficiently withstand the surge voltage level of $V_{ZP}$. This eliminates the necessity for any elaborate considerations of the material, thickness, creeping distance, etc. of the insulating members and thus contributes to the realization of miniaturization and cost reduction of the apparatus for mounting the DIS.

If the system were arranged to block a surge voltage of 40 kV to 50 kV or more only by a diode circuit, a plurality of diodes should be connected in series for that purpose since, it is difficult to make a diode which alone can block or withstand such a high surge voltage. In such an arrangement, due to the fact that the dv/dt value of the surge voltage is relatively high and the junction and/or earth capacities of the respective diodes are usually different from each other, the surge voltage is generally not distributed uniformly among the respective diodes thereby disadvantageously reducing the resultant capability of surge-voltage blocking by the series connection of the diodes. The embodiment of the present invention can obviate the above defect since the level of $V_{ZP}$ is selected to be about 25 kV, and the blocking of a surge voltage less than $V_{ZP}$ is achieved by a single diode device.

The $V_{ZP}$ of the diodes employed in the embodiment of the present invention is suitably selected to minimize power consumed in the diode due to absorption of the surge voltage, which is desirable in that generation of heat in the diode can be minimized, and a diode of small size having a surge voltage withstanding capability lower than that of large size can be employed.

The embodiment of the present invention is advantageous for the miniaturization and cost reduction of the DIS apparatus because the diode itself has the surge absorbing means associated therewith.

Another embodiment or a modification of the present invention will be described with reference to FIG. 5. Although the circuit connected to the primary winding 111 of the ignition coil 11 is illustrated in a more basic and schematic form than that in FIG. 1, it is apparent that the function of the former is equivalent to that of the latter. Reference numerals 21 and 22 generally designate switching means which may be mechanical contacts or transistors such as those shown in FIG. 1 or any other semiconductor switches including thyristors. When the switching means 21 and 22 are semiconductor switches such as transistors or thyristors, it is obvious that a control circuit (not shown) for driving the same is required.

Figure 5:
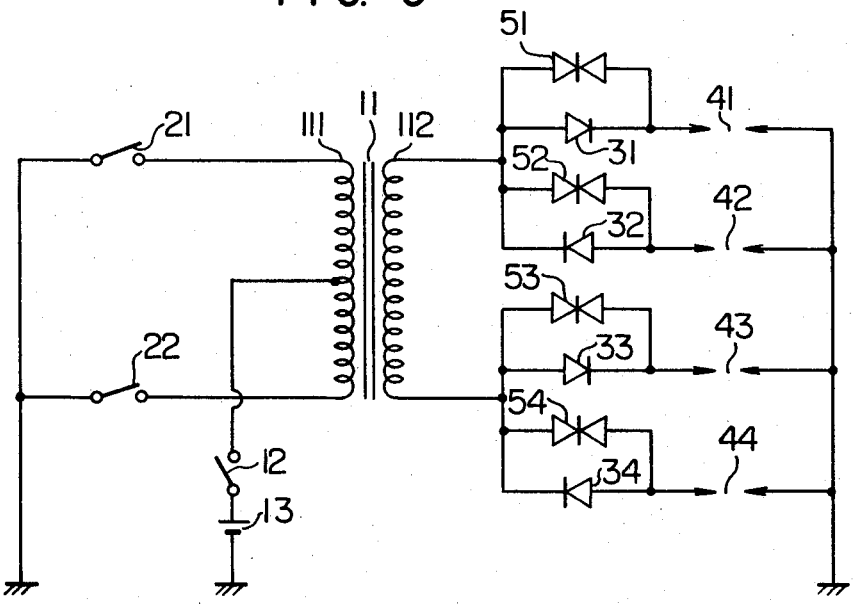
FIGS. 5 and 8 are circuit diagrams of other embodiments of the DIS according to the present invention respectively.

Referring to FIG. 5, surge absorbing means 51, 52, 53 and 54 are connected in parallel with conventional diodes 31, 32, 33 and 34 respectively. Each of these surge absorbing means 51 to 54 exhibits a V-I characteristic similar to that shown in FIG. 4 in a direction parallel to the reverse direction of the diode connected in parallel therewith. Such a surge absorbing means may be a surge arrester which is in the form of, for example, a sintered block of zinc oxide (ZnO). In another form, the surge absorbing means may be a stack of a required number of semiconductor surge arrestors of three-layer structure, that is, NPN or PNP structure.

The embodiment shown in FIG. 5 is as effective as that shown in FIG. 1 in the function of absorbing the surge voltage by the surge absorbing means.

In still another embodiment of the present invention, capacitors are used as surge absorbing means. This embodiment is a modification of that shown in FIG. 5 in that the surge absorbing means 51, 52, 53 and 54 in FIG. 5 are replaced by capacitors respectively. The capacitors employed in this embodiment have a capacitance of about several pF. While a conventional diode includes a very small inherent capacitance formed between the pair of electrodes, this capacitance value is too small to be utilized as surge absorbing means, and it is therefore necessary to positively add a capacitor thereto as in the third embodiment. Thus, in this third embodiment, discrete capacitors are connected in parallel with the diodes 31, 32, 33 and 34 respectively.

Figure 6:
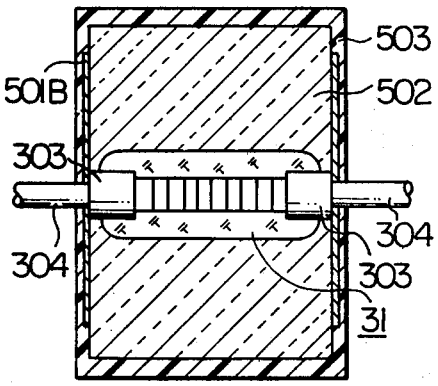
FIGS. 6 and 7 are schematic sectional views of two forms respectively of the diode preferably employed in the DIS shown in FIG. 5.

In a modification of the third embodiment, each of the diodes 31, 32, 33 and 34 may be so constructed that a predetermined capacitance may be present between the pair of electrodes. The practical structure of the diode in such a modification will be described with reference to FIG. 6. Referring to FIG. 6, reference numeral 31 designates a diode whose structure is the same as that shown in FIG. 3 except the absence of the resin envelope 306. In the diode structure shown in FIG. 6, however, the constant voltage characteristic is not expected for the diode 31 itself. In FIG. 6, a pair of spaced conductive flat plates 501A and 501B are disposed adjacent to and electrically connected to the electrodes 303 respectively. These flat plates 501A and 501B extend in the radial direction from the associated ends of the electrodes 303 of the diode 31 connected to the leads 304, respectively. The space between the conductive flat plates 501A and 501B is packed with a dielectric material 502 such as an epoxy resin having a relative permittivity larger than unity (1), so that a capacitor is formed by these flat plates 501A and 501B and is connected in parallel with the diode 31. The surface of this capacitor is covered with a resin 503 to be protected from the ambient atmosphere. The capacitance of this capacitor can be adjusted as desired by, for example, changing the area of the flat plates 501A, 501B and the composition of the resin 502. For example, the resin 502 may be any one of epoxy resin, polyester resin, polybutadiene resin, polyethersulfon resin and noryl resin which is selected depending on the desired value for the capacitance. The capacitance of the capacitor in the structure shown in FIG. 6 in several pF, and this capacitance value is enough to effectively absorb a surge voltage of several-ten kV.

The structure shown in FIG. 6 can be provided by any one of suitable methods. A most preferred method includes the steps of covering the peripheral surface of the diode 31 with a resin 502 having a predetermined diameter, coating a conductive paste on the axially opposite ends of the resin block 502 to form the pair of electrodes 501A and 501B, and finally covering the assembly with a resin 503 acting as a protecting layer.

Figure 7:
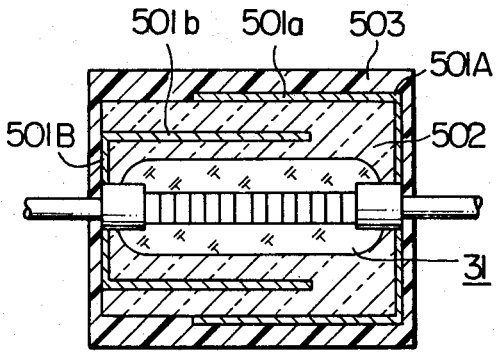

FIG. 7 shows, in an axial sectional view, the structure of a modification of the diode with capacitor shown in FIG. 6. The structure shown in FIG. 7 differs from that shown in FIG. 6 in that the plates 501A and 501B include flat portions and cylindrical extensions 501*a* and 501*b* connected thereto and having different diameters respectively, and these cylindrical extensions 501*a* and 501*b* oppose partly each other with portions of the resin 502 interposed therebetween. The size of the structure shown in FIG. 7 can be made smaller than that shown in FIG. 6 when they have the same capacitance.

While the foregoing description has referred to application of the present invention to a DIS for use in a 4-cylinder internal combustion engine and to an apparatus to be used for the DIS, the present invention is equally effectively applicable to a DIS for use in internal combustion engines having more cylinders. The present invention is also applicable to a DIS for a 2-cylinder internal combustion engine in which spark plugs are connected to the opposite ends respectively of the secondary winding of the ignition coil, and diodes are connected in parallel with the respective spark plugs in the same direction with respect to the ends of the secondary winding of the ignition coil.

Figure 8:
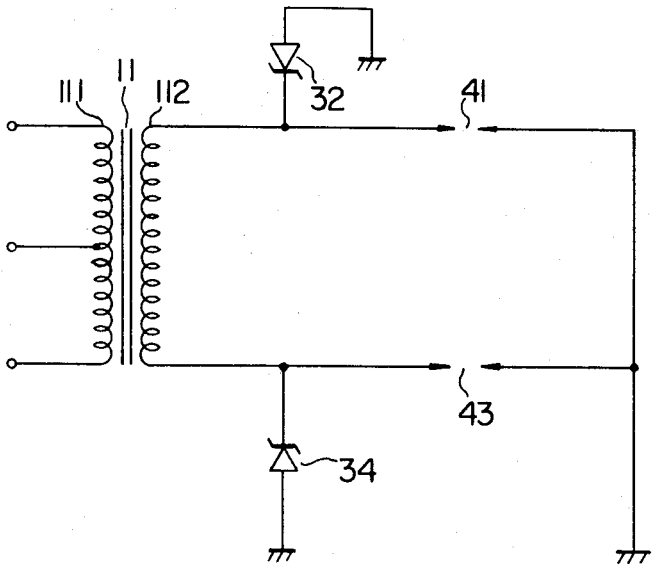

One of the example for such circuit arrangement is shown in FIG. 8 in which the similar components are designated by the same reference numerals as those in FIG. 1 and the primary winding of the ignition coil 11 is connected to a power source through switching circuit (not shown) substantially the same as that shown in FIG. 1 or 5. Zener diode 32 and spark plug 43 constitutes a closed circuit with the terminals of the secondary winding 112, while zener diode 34 and spark plug 41 constitutes another closed circuit with the same terminals.

What is claimed is:

1. A distributorless ignition system comprising:

(a) an ignition coil including a primary winding and a secondary winding;

(b) power source means connected to the primary winding of said ignition coil for supplying to said primary winding a primary current alternately flowing in a first direction thereby inducing across said secondary winding a secondary voltage alternately changing between a first polarity and a second polarity; and (c) a plurality of rectifying means, each having surge absorbing means associated therewith, and a plurality of spark gap means connected to the secondary winding of said ignition coil so as to constitute at least two closed circuits with said rectifying means, said rectifying means in the closed circuits being arranged in such a relation that one of them is forward directed while the other is reverse directed when the secondary voltage of the first polarity is induced in said secondary winding, whereby a spark gap jumps across the spark gap means connected in one of said closed circuits with said rectifying means which is forward directed with respect to the secondary voltage of the first polarity induced in said secondary winding, each of said rectifying means having surge absorbing means associated therewith being a diode exhibiting a constant voltage characteristic in its reverse direction without failure of the diode.

2. An apparatus to be used for a distributorless ignition system comprising:

(a) an ignition coil including a primary winding and a secondary winding;

(b) at least two rectifying means each having surge absorbing means associated therewith and connected at one of the terminals thereto to the secondary winding of said ignition coil, each of said rectifying means having said surge absorbing means associated therewith being a diode which exhibits a constant voltage characteristic in its reverse direction without failure of the diode;

(c) packaging means for packaging therein said ignition coil and said rectifying means having said surge absorbing means associated therewith; and (d) first and second terminal means electrically insulated from one another, said first terminal means providing external electrical connections for the ends of the primary winding of said ignition coil to be connected to an electric power source for the distributorless ignition system said second terminal means providing external electrical connections for the other terminal of said rectifying means to be connected to spark gap means of the distributorless ignition system.

3. An apparatus to be used for a distributorless ignition system comprising:

(a) an ignition coil including a primary winding and a secondary winding;

(b) at least two rectifying means each having surge absorbing means associated therewith and connected at one of the terminals thereof to the secondary winding of said ignition coil, said surge absorbing means operating in a voltage range which is higher than the level required for causing jumping of a spark across said spark gap means but lower than a breakdown voltage of a portion of the electrical insulating materials having a lowest dielectric breakdown voltage, each of said rectifying means having said surge absorbing means associated therewith being a diode which exhibits a constant voltage characteristic in its reverse direction without failure of the diode;

(c) packaging means for packaging therein said ignition coil and said rectifying means having said surge absorbing means associated therewith; and (d) first and second terminal means electrically insulated from one another, said first terminal means providing external electrical connections for the ends of the primary winding of said ignition coil to be connected to an electrical power source for the distributorless ignition system said second terminal means providing external electrical connections for the other terminal of said rectifying means to be connected to spark gap means of the distributorless ignition system.

* * * * *